US008124195B2

(12) United States Patent
Hama et al.

(10) Patent No.: US 8,124,195 B2
(45) Date of Patent: Feb. 28, 2012

(54) PATTERN FORMING METHOD AND DROPLET DISCHARGE DEVICE

(75) Inventors: Yoshikazu Hama, Okaya (JP); Hirotsuna Miura, Fujimi (JP)

(73) Assignee: Seiko Epson Corporation (JP)

( * ) Notice: Subject to any disclaimer, the term of this patent is extended or adjusted under 35 U.S.C. 154(b) by 815 days.

(21) Appl. No.: 12/178,695

(22) Filed: Jul. 24, 2008

(65) Prior Publication Data

US 2009/0033696 A1 Feb. 5, 2009

(30) Foreign Application Priority Data

Aug. 2, 2007 (JP) ..... 2007-201980

(51) Int. Cl.
*B05D 1/38* (2006.01)

(52) U.S. Cl. ..... 427/555; 427/261

(58) Field of Classification Search ..... 427/555, 427/261

See application file for complete search history.

(56) References Cited

U.S. PATENT DOCUMENTS

2006/0209150 A1 * 9/2006 Iwata ..... 347/102

FOREIGN PATENT DOCUMENTS

| | | |
|---|---|---|
| JP | 2005-095849 | 4/2005 |
| JP | 2006-255656 | 9/2006 |
| JP | 2006-272152 | 10/2006 |
| JP | 2006-305403 | 11/2006 |

* cited by examiner

*Primary Examiner* — Frederick Parker

(74) *Attorney, Agent, or Firm* — Harness, Dickey & Pierce, P.L.C.

(57) ABSTRACT

A pattern formation method includes discharging a functional liquid substance having a functional material to an object, and irradiating the functional liquid substance with light emitted from a light source thereby to form a pattern of a functional film on the object. In this method, when the thickness of the functional liquid substance on an optical axis of the light is L and the absorption coefficient of the functional liquid substance for the light is α, the thickness and the absorption coefficient are set so as to satisfy an equation (1):

$$0.1 \leq \alpha \cdot L \leq 0.7 \quad (1).$$

10 Claims, 8 Drawing Sheets

PATTERN FORMING METHOD AND DROPLET DISCHARGE DEVICE

BACKGROUND

1. Technical Field

The present invention relates to a pattern forming method and a droplet discharge device.

2. Related Art

A multilayer substrate made of low temperature co-fired ceramics (LTCC) has excellent high-frequency characteristics and high heat resistance, and therefore is widely used for, e.g., substrates of high-frequency modules and substrates of IC packages.

Processes for manufacturing an LTCC multilayer substrate generally include a process of drawing a circuit pattern on a green sheet by using metal ink, and a process of laminating a plurality of green sheets and collectively firing the circuit pattern and each green sheet.

Regarding the process of drawing a circuit pattern, an inkjet method of discharging minute droplets of metal ink (e.g., JP-A-2006-272152, which is referred to as a "first related art example" hereinafter) is proposed to achieve high density of a circuit pattern.

The inkjet method draws a circuit pattern using a large number of droplets each ranging from several to several ten picoliters in volume, and changes the discharging position of the droplets, thereby enabling the circuit pattern to be made fine and the pitch to be made narrow.

However, when the inkjet method is used, the droplets that have landed on an object wet and spread in accordance with the state of the surface of the object.

This causes variations in size and form of the pattern after the droplets have dried.

Thus, regarding the inkjet method, a technique to suppress wetting and spreading of droplets to a desired size becomes necessary as the pattern is made finer and the pitch is made narrower.

The first related example discloses a method of applying a plurality of functional liquid materials exerting the same function (e.g., conductivity) and having different light-heat conversion efficiency onto an object one on top of the other.

Then, irradiating one functional liquid material with electromagnetic waves (e.g., laser beams) causes the functional liquid material to exert functionality, and light-heat conversion of the functional liquid material causes the other functional liquid material to exert functionality.

With this method, energy of electromagnetic waves to be input to functional liquid materials can be reduced, and a good-quality functional film pattern can be obtained.

JP-A-2006-305403, which is referred to as a "second related art example" hereinafter, discloses a method of applying electromagnetic waves (e.g., laser beams) in the normal line direction with respect to each position of the external surface of a functional liquid substance adhered onto an object.

With this method, the incident angle of electromagnetic waves to each surface of the functional liquid substance becomes small, enabling the suppression of the reflection of the electromagnetic waves to the minimum.

As a result, the applied electromagnetic waves are absorbed by the functional liquid substance with high efficiency.

If a functional liquid substance is irradiated with electromagnetic waves so that the functional liquid substance dries or dries and is fired, the functional liquid substance starts to dry on its surface.

This makes it difficult for electromagnetic wave to proceed into the interior of the functional liquid substance.

As a result, the surface of the functional liquid substance locally dries while most of its interior does not dry, and therefore the functional liquid substance wets and spreads.

In particular, if metal ink including metal fine particles is used as a functional liquid substance, most of light is absorbed into the surface of the metal ink thereby to form a metal film on the surface of the metal ink.

This metal film reflects most of the light applied to the functional liquid substance, and therefore suppresses the subsequent drying of the metal ink.

The second related art example increases the absorption coefficient of the functional liquid substance for electromagnetic waves.

On the other hand, the second related art example is not a technique of decreasing a difference in absorption coefficient between the surface and interior of the functional liquid substance.

Therefore, the second related art example cannot achieve sufficiently uniform dry state of the functional liquid substance.

SUMMARY

An advantage of the present invention is to provide a pattern formation method and a droplet discharge device that improve processing precision of a pattern by improving uniformity of dry state of a functional liquid substance.

A pattern formation method according to a first aspect of the invention includes discharging a functional liquid substance having a functional material to an object, and irradiating the functional liquid substance with light emitted from a light source thereby to form a pattern of a functional film on the object. In the method, when the thickness of the functional liquid substance on an optical axis of the light is L and the absorption coefficient of the functional liquid substance for the light is $\alpha$, the thickness and the absorption coefficient are set so as to satisfy an equation (1):

$$0.1 \leqq \alpha \cdot L \leqq 0.7 \quad (1).$$

With the pattern formation method according to the first aspect of the invention, light applied to a functional liquid substance is uniformly absorbed into the whole of the functional liquid substance along the proceeding direction of the light.

Thus, the pattern formation method according to the first aspect of the invention can make the dry state of a functional liquid substance uniform, and therefore can improve the processing precision of a pattern.

A pattern formation method according to a second aspect of the invention includes discharging a functional liquid substance having a functional material to an object, and irradiating the functional liquid substance with light emitted from a light source and light emitted from the light source and reflected by the object thereby to form a pattern of a functional film on the object. In the method, when the thickness of the functional liquid substance on an optical axis of the light is L, the absorption coefficient of the functional liquid substance for the light is $\alpha$, and the reflectance of the light by the object is R, the thickness and the absorption coefficient are set so as to satisfy equations (2) and (3):

$$\alpha \cdot L \leq 0.43 \cdot \log(2.5 + 2.5R + 2.5\sqrt{1 + 1.8R + R^2}). \quad (2)$$

$$\alpha \cdot L \geq 0.43 \cdot \log[0.13(5.0 - 5.0R + 5.0\sqrt{1 + 1.2R + R^2})]. \quad (3)$$

With the pattern formation method according to the second aspect of the invention, light from a light source and light from an object are uniformly absorbed into the whole of a functional liquid substance along the proceeding directions of the light.

Thus, the pattern formation method according to the second aspect of the invention can make the dry state of the functional liquid substance uniform, and therefore can improve the processing precision of a pattern.

In this pattern formation method, when the functional liquid substance is discharged as a droplet and the droplet before landing on the object is irradiated with the light, the thickness may be set by selection of the diameter of the droplet.

In this pattern formation method, when the functional liquid substance is discharged as a droplet, a liquid film made of plural ones of the droplet is formed on the object, and the liquid film is irradiated with the light, the thickness may be set by selection of the film thickness of the liquid film along a proceeding direction of the light.

With the above pattern formation method, the diameter of a droplet or the film thickness of a liquid film is set to the selected thickness, and therefore light applied to a functional liquid substance is uniformly absorbed into the whole of the functional liquid substance along the proceeding direction of the light.

Thus, this pattern formation method can make the dry state of the functional liquid substance uniform, and therefore can improve the processing precision of a pattern.

In this pattern formation method, the light may be laser light, and the absorption coefficient may be set by selection of the wavelength of the laser light.

With this pattern formation method, the wavelength of light is selected on the basis of the absorption coefficient, and therefore light applied to a functional liquid substance is uniformly absorbed into the whole of the functional liquid substance along the proceeding direction of the light.

Thus, this pattern formation method can make the dry state of the functional liquid substance uniform, and therefore can improve the processing precision.

In this pattern formation method, the absorption coefficient may be set by selection of the concentration of the functional material.

With this pattern formation method, the concentration of a functional material is selected on the basis of the absorption coefficient, and therefore light applied to a functional liquid substance is uniformly absorbed into the whole of the functional liquid substance along the proceeding direction of the light.

Thus, this pattern formation method can make the dry state of the functional liquid substance uniform, and therefore can improve the processing precision of a pattern.

In this pattern formation method, the functional liquid substance may be a liquid including a coloring matter that absorbs the light, and the absorption coefficient may be set by selection of the concentration of the coloring matter.

With this pattern formation method, the concentration of a coloring matter is selected on the basis of the absorption coefficient, and therefore light applied to a functional liquid substance is uniformly absorbed into the whole of the functional liquid substance along the proceeding direction of the light.

Thus, this pattern formation method can make the dry state of the functional liquid substance uniform, and therefore can improve the processing precision of a pattern.

In this pattern formation method, the functional material may be a metal fine particle, and the absorption coefficient may be set by selection of at least one of the particle size of the metal fine particle and the distance between particles of the metal fine particle.

With this pattern formation method, the particle size of a metal fine particle or the distance between particles of a metal fine particle is selected on the basis of the absorption coefficient, and therefore light applied to a functional liquid substance is uniformly absorbed into the whole of the functional liquid substance along the proceeding direction of the light.

Thus, this pattern formation method can make the dry state of the functional liquid substance uniform, and therefore can improve the processing precision of a pattern.

A droplet discharge device according to a third aspect of the invention includes a droplet discharge head for discharging a functional liquid substance having a functional material as a droplet to an object, and an irradiating portion for irradiating the functional liquid substance discharged from the droplet discharge head with light. In the device, when the thickness of the functional liquid substance on an optical axis of the light is L, and the absorption coefficient of the functional liquid substance for the light is $\alpha$, the equation (1) is satisfied.

With the droplet discharge device according to the third aspect of the invention, light applied to a functional liquid substance is uniformly absorbed into the whole of the functional liquid substance along the proceeding direction of the light.

Thus, the droplet discharge device according to the third aspect of the invention can make the dry state of a functional liquid substance uniform, and therefore can improve the processing precision of a pattern.

A droplet discharge device according to a fourth aspect of the invention includes a droplet discharge head for discharging a functional liquid substance including a functional material as a droplet to an object, and an irradiating portion for irradiating the functional liquid substance discharged from the droplet discharge head with light emitted from a light source and light emitted from the light source and reflected by the object. In the device, when the thickness of the functional liquid substance on an optical axis of the light is L, the absorption coefficient of the light of the functional liquid substance is $\alpha$, and the reflectance of the light of the object is R, the equations (2) and (3) are satisfied.

With the droplet discharge device according to the fourth aspect of the invention, light applied to a functional liquid substance is uniformly absorbed into the whole of the functional liquid substance along the proceeding direction of the light.

Thus, the droplet discharge device according to the fourth aspect of the invention can make the dry state of a functional liquid substance uniform, and therefore can improve the processing precision of a pattern.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described.

First Embodiment

A first embodiment that gives a concrete form to the present invention will be described below referring to FIGS. 1 to 8.

Figure 1:
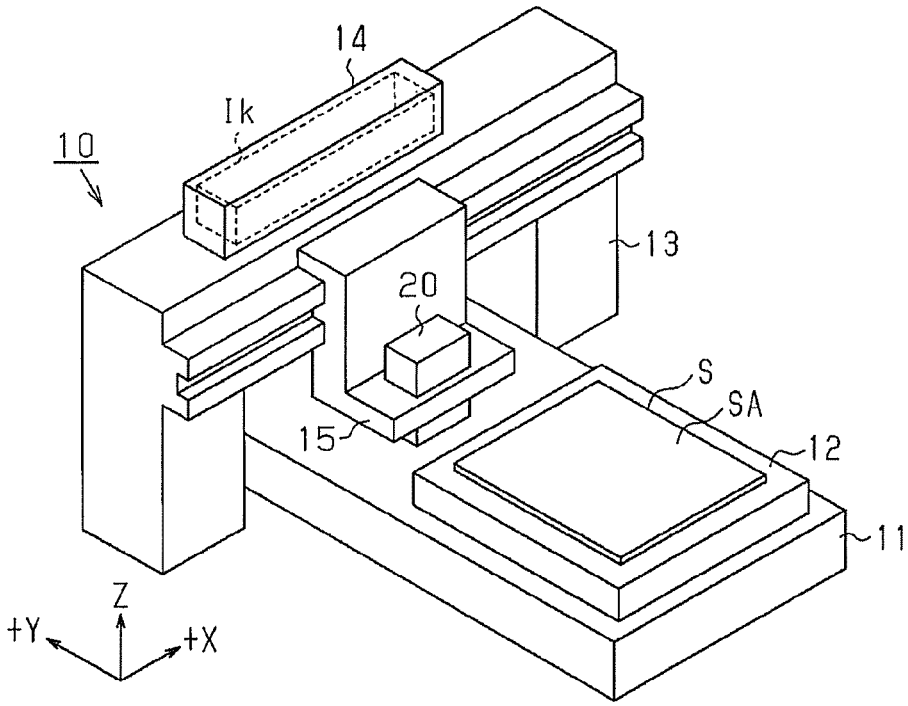
FIG. 1 is a perspective view showing a droplet discharge device of a first embodiment.

FIG. 1 is a perspective view showing the whole of a droplet discharge device 10.

In FIG. 1, the droplet discharge device 10 includes a base 11 extending in one direction, and a stage 12 placed on the base 11 and mounting a substrate S thereon.

The stage 12 positions and fixes the substrate S with one surface thereof turned upward and transports the substrate S along the longitudinal direction of the base 11.

As the substrate S, various substrates such as green sheets, glass substrates, silicon substrates, ceramic substrates, resin films and paper are used.

In the present embodiment, the top surface of the substrate S is referred to as a "discharge surface SA".

The discharge surface SA is a surface for forming a desired pattern, and has a position, as a target point, onto which droplets are to be discharged.

A direction along which the substrate S is transported and that is toward the upper left in FIG. 1 is referred to as a "+Y direction".

A direction that is orthogonal to the +Y direction and that is toward the upper right in FIG. 1 is referred to as a "+X direction", and the normal direction of the substrate S is referred to as a "Z direction".

The droplet discharge device 10 has a gate type guide member 13 straddling the base 11 and an ink tank 14 disposed on the upper side of the guide member 13.

The ink tank 14 stores ink Ik as a functional liquid substance, and discharges the stored ink Ik at a predetermined pressure.

As the ink Ik, various inks such as silver ink containing silver fine particles as a functional material, ITO (indium tin oxide) ink containing ITO fine particles, and pigmented ink containing a pigment are used.

The guide member 13 supports a carriage 15 movably along the +X direction and its opposite direction (−X direction).

The carriage 15 with the head unit 20 mounted thereon moves in the +X direction and the −X direction.

The carriage 15 moves in the +X direction and the −X direction when the substrate S is transported in the +Y direction, thereby arranging the head unit 20 on a target point of a transport path.

Note that an operation of transporting the substrate S in the +Y direction is referred to as "main scanning", and an operation of transporting the head unit 20 in the +X direction and the −X direction to set the head unit 20 on the transport path of the target point is referred to as "sub-scanning".

Next, the head unit 20 will be described below.

Figure 2:
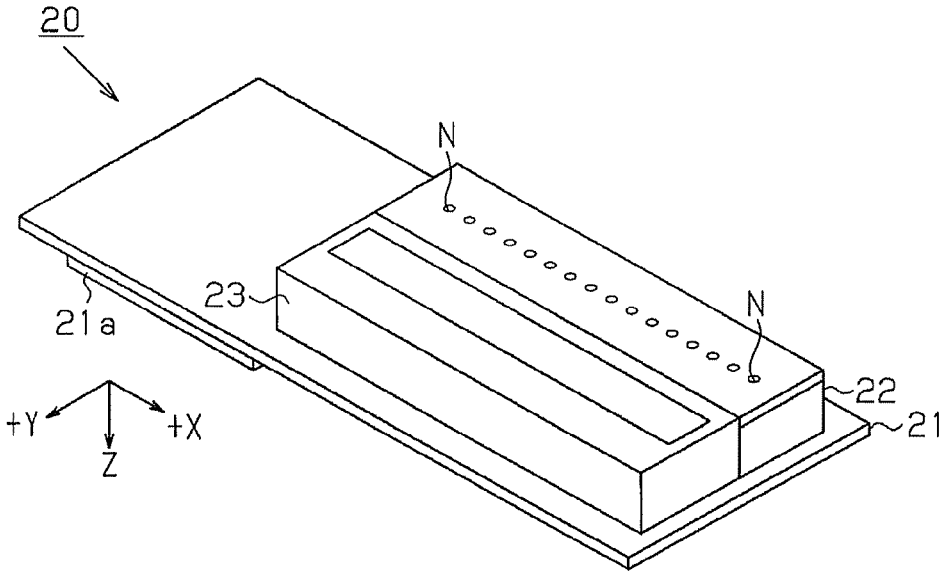
FIG. 2 is a perspective view showing a droplet discharge head of the same embodiment as in FIG. 1.

FIG. 2 is a perspective view of the head unit 20 as seen from the stage 12.

Figure 3:
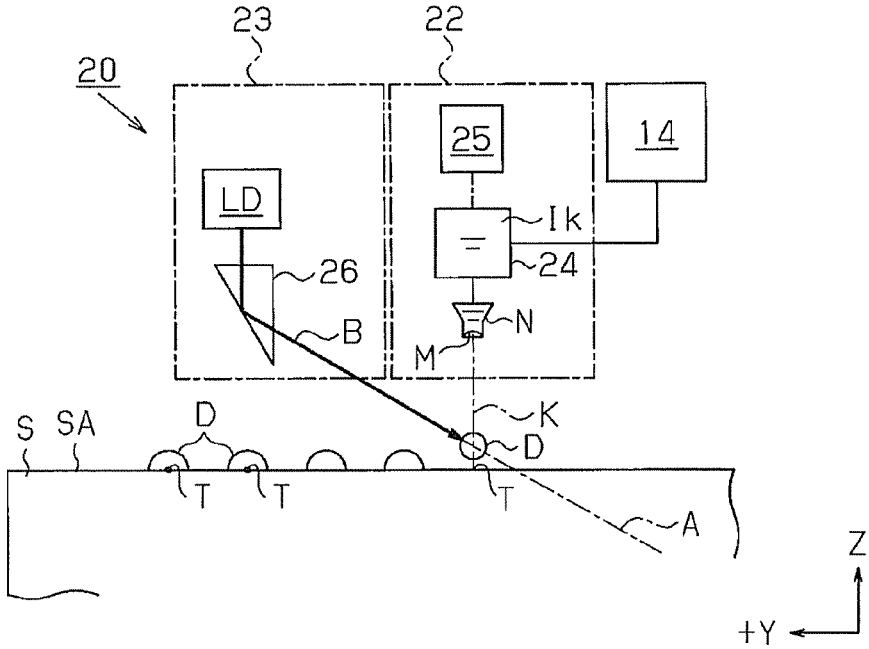
FIG. 3 schematically shows the interior of the droplet discharge head of the same embodiment as in FIG. 1.

FIG. 3 schematically shows the interior of the head unit 20.

In FIG. 2, the head unit 20 has a head substrate 21 extending in the +X direction, a droplet discharge head 22 mounted on the head substrate 21, and a laser head 23 that is mounted on the head substrate 21 and disposed in the +Y direction of the droplet discharge head 22.

The head substrate 21 is positioned and fixed onto the carriage 15, and moves along the +X direction and the −X direction with respect to the substrate S.

The head substrate 21 has an input terminal 21*a* in a side end thereof and outputs various drive signals input to the input terminal 21*a* to the droplet discharge head 22 and the laser head 23.

The droplet discharge head 22 has i (i is an integer of one or more) nozzles N over substantially the overall width in the +X direction of the side surface facing the substrate S.

Each nozzle N is a round hole extending in the Z direction, and is formed along the +X direction at a predetermined pitch.

For example, the droplet discharge head 22 has 180 nozzles N arranged along the +X direction at a pitch of 141 μm.

Note that, in FIG. 2, the number of nozzles N is reduced for ease of illustrating the arrangement of the nozzles N.

In FIG. 3, the droplet discharge head 22 has, for each nozzle, one cavity 24 and one pressure generation element 25 that provides pressure to the interior of the cavity 24.

Namely, the droplet discharge head 22 has i cavities 24 and i pressure generation elements 25, the numbers of which are equal to the number of nozzles N.

Each cavity 24 and each pressure generation element 25 are disposed directly above the nozzle N, so that they are associated with the nozzle N.

Each cavity 24 is connected to the ink tank 14, which is common to all the cavities, contains the ink Ik from the ink tank 14, and supplies the ink Ik to the nozzle N communicated with the cavity 24.

Each nozzle N receives the ink Ik from the cavity 24 communicated therewith and forms a liquid-vapor interface (hereinafter referred to simply as a "meniscus") M in an opening of the nozzle N itself.

Each pressure generation element 25 provides a predetermined pressure to the inside of the cavity 24 connected therewith to increase and decrease the pressure inside the concerned cavity 24, thereby vibrating the meniscus M of the nozzle N communicated with the concerned cavity 24.

As the pressure generation element 25, for example, a piezoelectric element mechanically increasing and reducing the volume of the cavity 24 or a resistance heating element locally increasing and decreasing the temperature of the cavity 24 may be used.

A target point T in the discharge surface SA passes directly under the nozzle N selected (hereinafter referred to simply as a "selected nozzle") when the substrate S is mainly scanned.

When the target point T is positioned directly under the selected nozzle, the cavity 24 communicated with the selected nozzle receives drive force of the corresponding pressure generation element 25 to vibrate the meniscus M of the selected nozzle, so that part of the ink Ik is discharged as droplets D each having a predetermined weight from the selected nozzle.

For example, the pressure generation element 25 makes part of metal ink contained in the cavity 24 to become the droplets D each having a weight of 10 ng, and makes the droplets D to be discharged from the nozzle N.

The droplets D discharged from the nozzle N fly along the normal line of the discharge surface SA and lands on a position directly under the selected nozzle, i.e., the target point T.

Note that in the present embodiment, the normal line of the discharge surface SA including the nozzle N is referred to as a "flight path K".

The diameter of the droplet D discharged from the nozzle N is referred to as a "liquid thickness L".

The liquid thickness L of the droplet D is determined by the vibration period and vibration amplitude of the meniscus M.

Namely, the liquid thickness L is determined by drive waveform signals COM input to the pressure generation element 25.

In the present embodiment, the liquid thickness L is selected to be suitable for the uniform dry of the droplet D.

In FIG. 3, the laser head 23 has one laser LD and one deflector 26 for each nozzle N.

Namely, the laser head 23 has i lasers LD and i deflectors 26, the numbers of which are equal to the number of the nozzles N.

Each laser LD and each deflector 26 are disposed in the +Y direction of the nozzle N, so that they are associated with the nozzle N.

Each laser LD is disposed in the +Y direction of the nozzle N, and emits laser light B when receiving predetermined drive signals.

The wavelength of the laser light B is absorption waves (e.g., 850 nm) of the ink Ik, and the intensity of the laser light B is set in advance based on an examination and the like.

In detail, the intensity of the laser light B is one that does not induce sudden boiling of the ink Ik receiving the laser light B, and is one that facilitates drying of the ink Ik receiving the laser light.

As the laser LD, a vertical cavity surface emitting laser (VCSEL) and a semiconductor laser may be used.

In the embodiment, an absorption coefficient that the ink Ik has and that is one per unit distance along the optical axis of the laser light B is referred to as an "absorption coefficient α".

Each deflector 26 receives the laser light B from its corresponding laser LD and bends the optical path of the laser light B toward a position directly under the nozzle N in the opposite direction to the +Y direction.

As a result of this, each deflector 26 forms an optical axis A that is in the −Y direction and intersects the flight path K.

As the deflector 26, for example, a triangular prism and a deflecting mirror may be used.

When the target point T in the discharge surface SA is positioned directly under the selected nozzle, the laser LD corresponding to the selected nozzle (hereinafer referred to simply as a "selected laser") emits the laser light B by receiving predetermined drive signals.

The laser light B from the selected laser proceeds along the optical axis A by receiving the deflection action of the deflector 26.

The droplet D discharged from the selected nozzle flies along the flight path K, and passes on the optical axis A (i.e., receives the laser light B) before its landing on the target point T.

The droplet D receiving the laser light B absorbs light energy of the laser light B, which evaporates a solvent or a dispersion medium of the ink Ik for the droplet D to start drying, and thereafter the droplet D lands on the target point T in the discharge surface SA.

The droplet D to land on the target point T has an increased viscosity due to drying before its landing by the laser light B.

Therefore, the droplet D is fixed while the wetting and spreading is suppressed in accordance with an increase in viscosity.

Note that the term "fix" in the embodiment means that the wetting and spreading of the droplet D that has landed is suppressed when the process proceeds to the back end processes (e.g., this drying process and a baking process) of the line so that the wetting and spreading has a size determined depending on requests from the back end processes.

In this way, the droplet discharge device 10 can process a pattern of a functional film made of a functional material (e.g., metal film) with high precision.

Next, a relationship between the absorption coefficient α for the laser light B that the ink Ik has and the liquid thickness L will be described.

Figure 4:
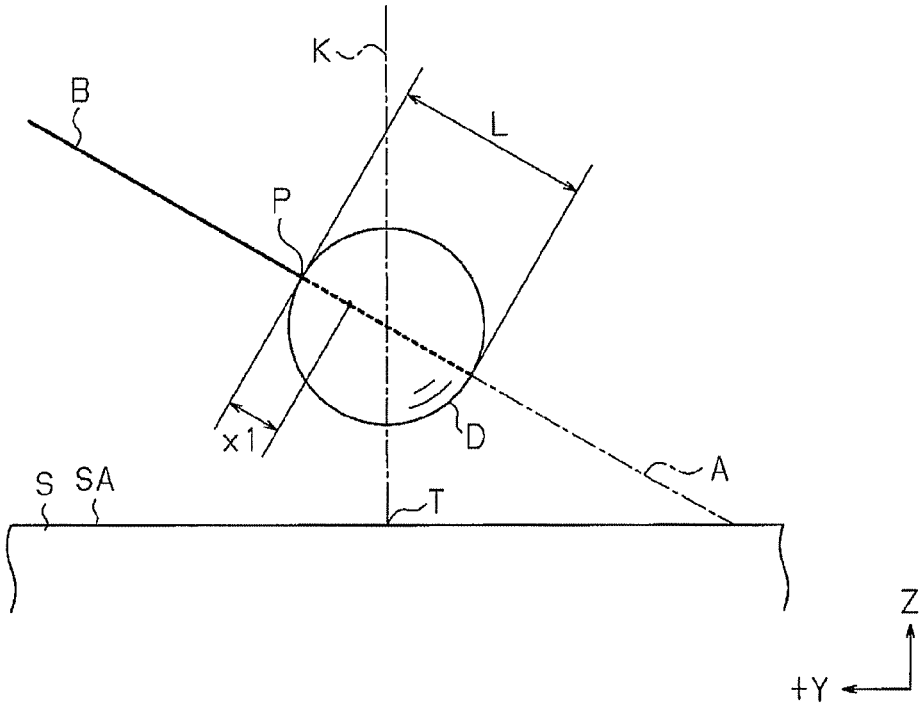
FIG. 4 schematically shows a state of irradiation of laser light of the same embodiment as in FIG. 1.

FIG. 4 schematically shows a state where the center of the droplet D is on the optical axis A.

In FIG. 4, an intersection point between the optical axis A and the surface of the droplet D and on a side on which the laser light B enters is referred to as an "origin P".

In FIG. 4, a one-dimensional coordinate system is defined on the optical axis A including the origin P, and a coordinate x1 is defined along the proceeding direction of the laser light B from the origin P.

In FIG. 4, when the intensity of the laser light B at the origin P is $I_0$, the intensity of the laser light B in the coordinate x1 is expressed by an equation (1-1) by applying the Lambert-Beer Law.

Supposing that energy per unit time and unit area absorbed by the ink Ik of the coordinate x1 is an absorption amount E, a difference δE in the absorption amount E between the coordinate x1 and coordinate x1+δx is expressed by an equation (1-2) by the use of the equation (1-1).

By solving the equation (1-2) for the absorption amount E, the absorption amount E in the coordinate x1 is expressed by an equation (1-3).

$$I=I_0\cdot 10^{-\alpha\cdot x1} \tag{1-1}$$

$$\delta E=I_0\cdot(10^{-\alpha\cdot x1}-10^{-\alpha(\alpha 1+\delta x)}) \tag{1-2}$$

$$E=(-1n10^{-\alpha})10^{-\alpha\cdot x1} \tag{1-3}$$

Further, supposing that the rate of total energy of the laser light B absorbed by the ink Ik from the origin P to the coordinate x1 with respect to the energy of the laser light B at the origin P is an absorptance ER, the absorptance ER is expressed by an equation (1-4) by the use of the equation (1-3).

$$ER=1-10^{-\alpha\cdot L} \tag{1-4}$$

Figure 5:
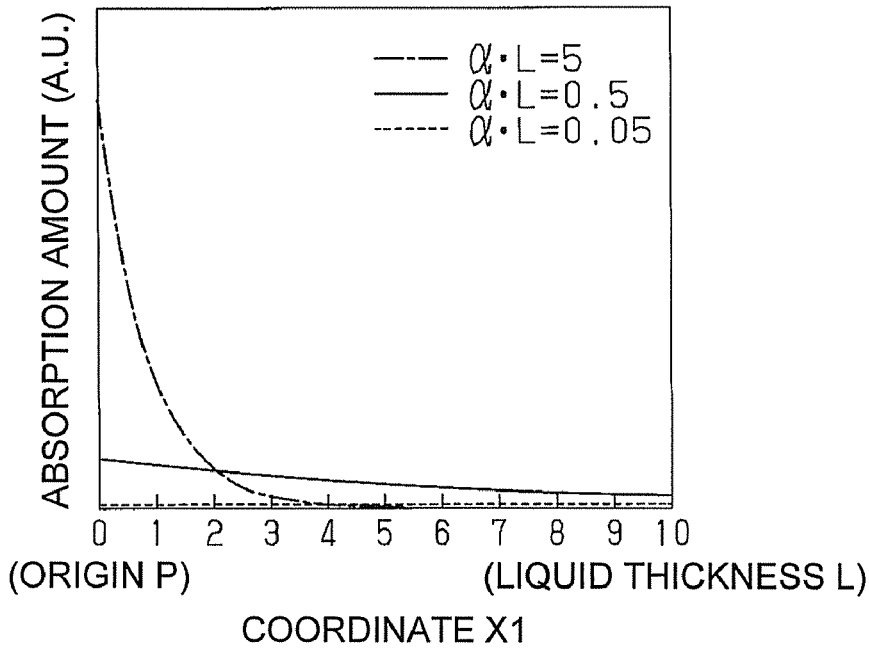
FIG. 5 shows relationships between the absorption amount and the liquid thickness of the same embodiment as in FIG. 1.
Figure 6:
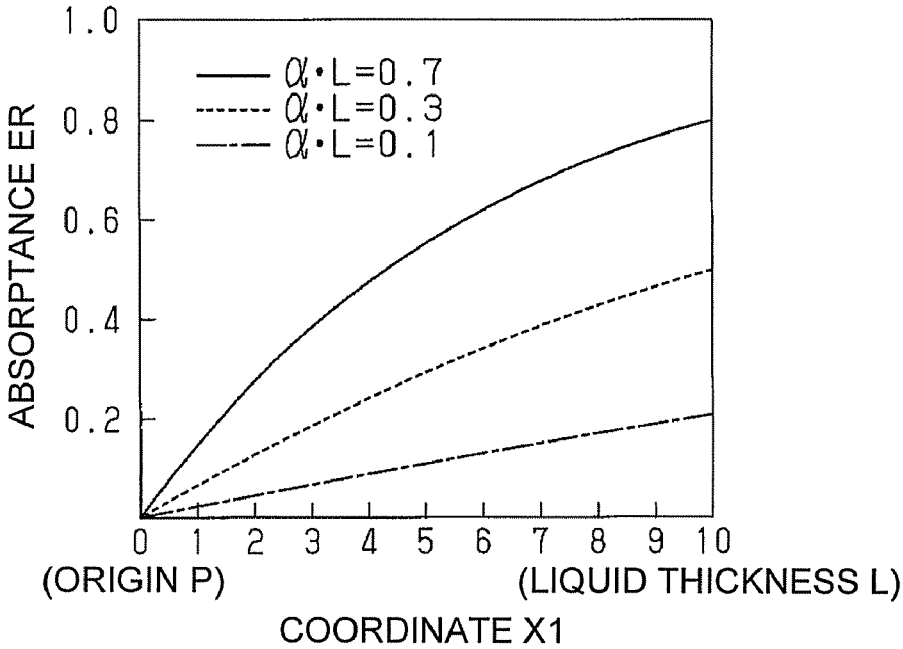
FIG. 6 shows relationships between the absorptance and the liquid thickness of the same embodiment as in FIG. 1.

The relationship between the absorption amount E and the coordinate x1, which is given by the equation (1-3), and the relationship between the absorptance ER and the coordinate x1, which is given by equation (1-4), are shown in FIGS. 5 and 6, respectively.

Note that, in FIGS. 5 and 6, it is supposed that the intensity $I_0$ is 1, and the liquid thickness L is 10 for the convenience of explanation.

FIG. 5 shows cases where the product of the absorption coefficient α and the liquid thickness L, i.e., α·L is set to 5, 0.5 and 0.05.

FIG. 6 shows cases where α·L is set to 0.1, 0.3 and 0.7.

In FIG. 5, regarding the droplet D for which α·L is set to 5 as indicated by an alternate long and short dash line, while the absorption amount E is relatively large at the origin P, the absorption amount E largely decreases as the distance from the origin P increases.

Namely, a large difference in the absorption amount E is given along the diameter direction of the droplet D.

Regarding the droplet D for which α·L is set to 0.5 as indicated by a continuous line, while the absorption amount E is greatly reduced at the origin P, the difference in the absorption amount E along the diameter direction is remarkably decreased, as compared with the droplet D that satisfies α·L=5.

Regarding the droplet D for which α·L is set to 0.05 as indicated by a broken line, while the absorption amount E is further reduced at the origin P, the difference in absorption amount E along the diameter direction is further reduced, as compared with the droplet D that satisfies α·L=0.5.

Accordingly, it is found that when the absorption coefficient α is constant, the uniformity in the absorption amount E along the diameter direction can be improved by selecting a thin liquid thickness L of the droplet D.

It is also found that when the liquid thickness L is constant, the uniformity in the absorption amount E along the diameter direction can be improved by selecting a low absorption coefficient α of the droplet D.

In the present invention, in order that the droplet D uniformly dry, the difference in the absorption amount E between the origin P and x1=L must be 80% or less of the absorption amount E of the origin P.

The rate of the absorption amount E of x1=L with respect to the absorption amount E of the origin P (x1=0) is given by $10^{-\alpha \cdot L}$ using the equation (1-3).

Therefore, in order that the droplet D uniformly dries, a·L is set to a value that satisfies $1\text{-}10^{-\alpha \cdot L} \leqq 0.8$, i.e., a value that satisfies a·L≦0.7.

In FIG. 6, regarding the droplet D for which a·L is set to 0.7 as indicated by a continuous line, the absorptance ER increases parabolically as the distance from the origin P increases such that 80% of the laser light B is absorbed until the coordinate x1=L.

Regarding the droplet D for which a·L is set to 0.3 as indicated by a broken line, the absorptance is decreased on the whole, as compared with the droplet D satisfying a·L=0.7, so that 60% of the laser beam B is absorbed until the coordinate x1=L.

Regarding the droplet D for which a·L is set to 0.1 as indicated by an alternate long and short dash line, the absorptance is further decreased on the whole, as compared with the droplet D satisfying a·L=0.5, so that 20% of the laser beam B is absorbed until the coordinate x1=L.

Accordingly, it is found that when the absorption coefficient α is constant, the absorptance ER, i.e., the efficiency in the use of the laser light B can be improved by selecting a thick liquid thickness L of the droplet D.

It is also found that when the liquid thickness L is constant, the absorptance ER, i.e., the efficiency in the use of the laser light B can be improved by selecting a high absorption coefficient α of the droplet D.

In the present invention, in order to secure the efficiency in the use of the laser light B, the absorptance ER of the droplet D must be 0.2 or more.

Thus, a·L is set to a value satisfying $ER=1\cdot 10^{-\alpha \cdot L} \leqq 0.2$, i.e., a value satisfying a·L≧0.1 by the use of the equation (1-4).

Therefore, in the droplet discharge device 10, a·L satisfying the equation (1) is set by the selection of the diameter of the droplet D, which allows each discharged droplet D to absorb the laser light B in a uniform manner and with high use efficiency.

$$0.1 \leqq \alpha \cdot L \leqq 0.7 \quad (1)$$

As a result, the droplet discharge device 10 can make the dried condition of the droplet D uniform to cause the droplet D landing on the target point T to be fixed in a narrow area including the target point T.

This leads to improvement in processing precision of a pattern formed of the droplets D.

The droplet discharge device 10 can also suppress the output of the laser light B to be low, thereby allowing saving of energy.

Figure 7:
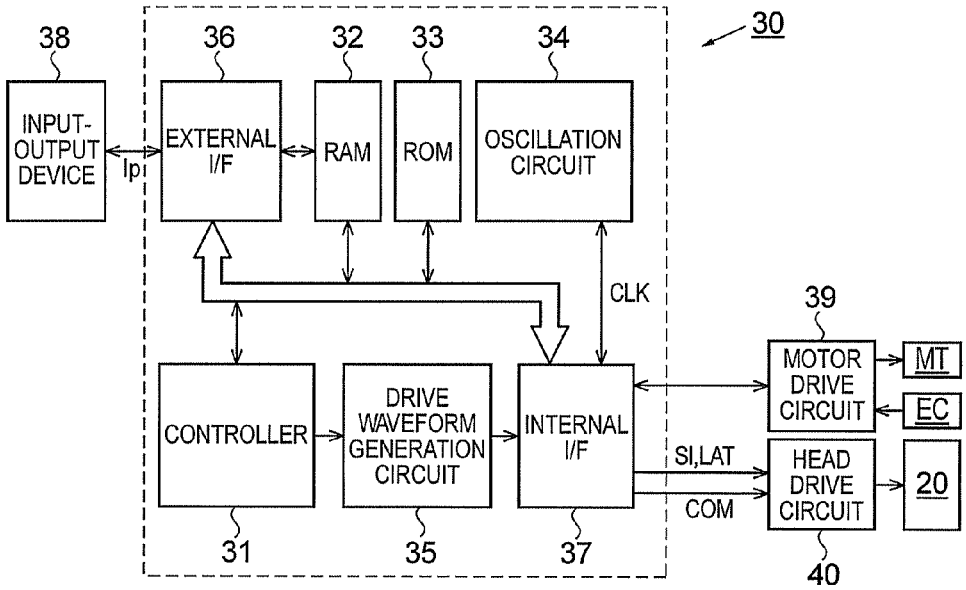
FIG. 7 is an electric block circuit diagram showing the electric configuration of the droplet discharge device of the same embodiment as in FIG. 1.
Figure 8:
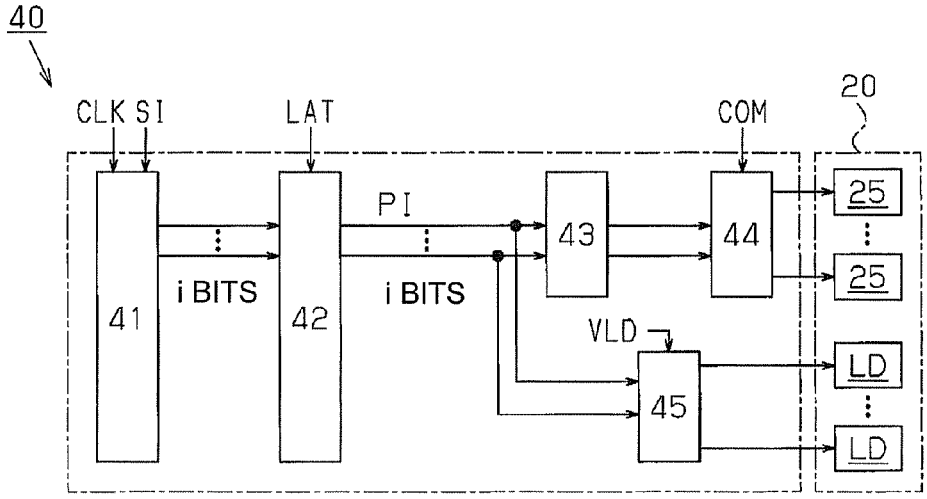
FIG. 8 is an electric block circuit diagram showing the electric configuration of a head drive circuit of the same embodiment as in FIG. 1.

Next, the electrical configuration of the droplet discharge device 10 is described according to FIGS. 7 and 8.

FIG. 7 is a block circuit diagram showing the electrical configuration of the droplet discharge device 10, and FIG. 8 is a block circuit diagram showing the electrical configuration of a head drive circuit.

In FIG. 7, a control device 30 causes the droplet discharge device 10 to carry out various processing operations.

The control device 30 includes a controller 31 composed of a CPU (central processing unit) and the like, a RAM (random access memory) 32 that has a DRAM (dynamic random access memory) and a SRAM (static random access memory) and in which various data is stored, and a ROM (read only memory) 33 in which various control programs are stored.

The control device 30 also includes an oscillation circuit 34 for generating clock signals, a drive waveform generation circuit 35 for generating drive waveform signals, an external I/F (interface) 36 for receiving various signals, and an internal I/F 37 for sending various signals.

The control device 30 is connected through the external I/F 36 to an input-output device 38.

The control device 30 is connected through the internal I/F 37 to a motor drive circuit 39 and a head drive circuit 40.

The input-output device 38 is an external computer having, e.g., a CPU, a RAM, a ROM, a hard disk and a liquid crystal display.

The input-output device 38 outputs various signals for driving the droplet discharge device 10 to the external I/F 36.

The external I/F 36 receives pattern data Ip for forming a pattern from the input-output device 38.

The term "pattern data Ip" means various data for carrying out discharge processing of the droplet D such as data on the speed of scanning of the substrate S, data on the discharge period of the droplet D, data on the position of the target point T and data on the size of the droplet D, i.e., the liquid thickness L selected to satisfy the equation (1).

The RAM 32 is used as a receive buffer, an intermediate buffer or an output buffer.

The ROM 33 stores various control routines to be executed by the controller 31 and various data for executing such control routines.

The ROM 33 stores data for performing discharge processing of the droplet D such as data on the quantity of the nozzles N and on the position of the nozzles N.

The oscillation circuit 34 generates clock signals for making various data and various drive signals in synchronization.

The oscillation circuit 34 generates a transmission clock CLK for serial transmission of, e.g., various data.

The oscillation circuit 34 generates timing signals LAT for parallel conversion of various data to be serially transmitted at a discharge period of the droplet D.

The drive waveform generation circuit 35 stores waveform data for generating drive waveform signals COM corresponding to a predetermined address.

The controller 31 reads waveform data for obtaining the liquid thickness L on the basis of the pattern data Ip.

The drive waveform generation circuit 35 latches the waveform data read by the controller 31 and converts the data into analog signals for every clock signals at a discharge period, and amplifies the analog signals to generate the drive waveform signals COM.

The external I/F 36 receives the pattern data Ip from the input-output device 38 and temporarily stores and converts the pattern data Ip into intermediate codes in the RAM 32.

The controller 31 reads the intermediate code data stored in the RAM 32 and generates dot pattern data.

The discharge surface SA has two-dimensional lattice points defined by discharge intervals in the +Y direction of the droplet D and by discharge intervals in the +X direction of the droplet D.

Selecting whether or not to discharge the droplet D is defined for each lattice point.

The term "dot pattern data" means data that associates each lattice point with whether or not it is the target point T, i.e., whether or not to discharge the droplet D.

After generating dot pattern data corresponding to one main scanning, the controller 31 generates serial data synchronizing with the transmission clock CLK by the use of the dot pattern data, and serially transmits the serial data through the internal I/F 37 to the head drive circuit 40.

In the present embodiment, serial data generated using dot pattern data is referred to as "serial pattern data SI".

The serial pattern data SI is data for causing discharge or non-discharge of the droplet D defined on the basis of dot pattern data to correspond to each pressure generation element 25, and is generated at a discharge period of the droplet D.

The controller 31 is connected through the internal I/F to the motor drive circuit 39 and outputs drive control signals corresponding to the motor drive circuit 39.

The motor drive circuit 39 is connected to various motors MT for moving the stage 12 and the carriage 15 and an encoder EC for detecting the number of rotations and the rotating direction of the motor MT.

The motor drive circuit 39 drives the motor MT in response to drive control signals from the controller 31 to perform sub-scanning using the carriage 15 and main scanning using the stage 12.

The motor drive circuit 39 receives detection signals from the encoder EC, calculates the direction and amount of movement of the stage 12 and the direction and amount of movement of the carriage 15, and outputs the results to the control device 30.

The control device 30 determines whether or not each lattice point is positioned directly under the nozzle N on the basis of the direction and amount of movement of the stage 12, and generates the timing signals LAT when each lattice point is positioned directly under the nozzle N.

Next, the head drive circuit 40 will be described below.

In FIG. 8, the head drive circuit 40 includes a shift register 41, a control signal generator 42, a level shifter 43, a pressure generation element switch 44 and a laser switch 45.

The shift register 41 receives the transmission clock CLK from the control device 30 and causes the serial pattern data SI to consecutively shift.

The shift register 41 stores the serial pattern data SI made of i bit values, where i is the number of the nozzles N.

The control signal generator 42 receives the timing signals LAT from the control device 30 and latches serial pattern data SI stored in the shift register 41.

The control signal generator 42 converts the latched serial pattern data SI from serial to parallel form to generate parallel data of i bits corresponding to the nozzles N, and outputs the parallel data to the level shifter 43 and to the laser switch 45.

In the present embodiment, the parallel data output by the control signal generator 42 is referred to as "parallel pattern data PI" as selection signals.

The level shifter 43 raises the voltage level of the parallel pattern data PI from the control signal generator 42 to a drive voltage level of the pressure generation element switch 44 to generate i switch signals associated with the pressure generation elements 25.

The pressure generation element switch 44 has i switch elements each associated with each of the pressure generation elements 25; the drive waveform signals COM from the control device 30 are input to an input end of each switch element, and connected to an output end of each switch element is the corresponding pressure generation element 25.

Each switch element outputs the drive waveform signals COM to the corresponding pressure generation element 25 in response to switch signals associated with the corresponding pressure generation element 25.

When the target point T is positioned directly under the selected nozzle, a head drive circuit 40 outputs the drive waveform signals COM to the corresponding pressure generation element 25.

Thus, the head drive circuit 40 discharges the droplet D having the liquid thickness L satisfying the equation (1) toward the target point T.

The laser switch 45 includes i switch elements each corresponding to each laser LD; a power supply VLD from the control device 30 is input to an input terminal of each switch element, and connected to an output terminal of each switch element is the corresponding laser LD.

Each switch element supplies drive current to the corresponding laser LD in correspondence to the parallel pattern data PI associated with the corresponding nozzle N for a predetermined time.

In this way, the head drive circuit 40 causes the laser light B to be applied onto the flight path K including the target point T only for a predetermined time when the droplet D is discharged toward the target point T.

Thus, the head drive circuit 40 causes the laser light B satisfying the equation (1) to be applied toward the droplet D of the liquid thickness L.

When each target point T of the discharge surface SA is positioned directly under the nozzle N by main scanning of the substrate S, the droplet discharge device 10 discharges the droplet D of the selected liquid thickness L from the selected nozzle and irradiates the droplet D before its landing with the laser light B from the selected laser.

Accordingly, the droplet discharge device 10 allows each discharged droplet D to absorb the laser light B in a uniform manner and with high use efficiency so as to perform discharge processing under a condition of satisfying the equation (1).

Next, effects of the first embodiment configured as described above will be described below.

(1) In the first embodiment, the droplet discharge device 10 discharges the ink Ik to the substrate S, and irradiates the ink Ik with the laser light B emitted from the laser LD.

Supposing that the thickness of the ink Ik on the optical axis A of the laser light B is L, and the absorption coefficient of the ink Ik for the laser light B is a, the droplet discharge device 10 selects and sets the thickness of the ink Ik satisfying $0.1 \leqq a \cdot L \leqq 0.7$.

Accordingly, the laser light B with which the ink Ik is irradiated is uniformly absorbed over the ink Ik along the progress direction of the laser light B.

Therefore, the droplet discharge device 10 can make the dry state of the ink Ik uniform, improving the processing precision of a pattern made of the ink Ik.

(2) In the first embodiment, when the droplet discharge device 10 discharges the ink Ik as the droplet D and irradiates the droplet D before its landing on the substrate S with the laser light B, the liquid thickness L is set by the selection of the diameter of the droplet D.

Accordingly, the laser light B with which the droplet D is irradiated is uniformly absorbed into the whole of the droplet D along the proceeding direction of the laser light B.

Second Embodiment

A second embodiment that gives a concrete form to the present invention will be described below referring to FIGS. 9 to 11.

The second embodiment utilizes the laser light B reflecting from the discharge surface SA in addition to the first embodiment.

Therefore, the changes will be described in detail below.

Figure 9:
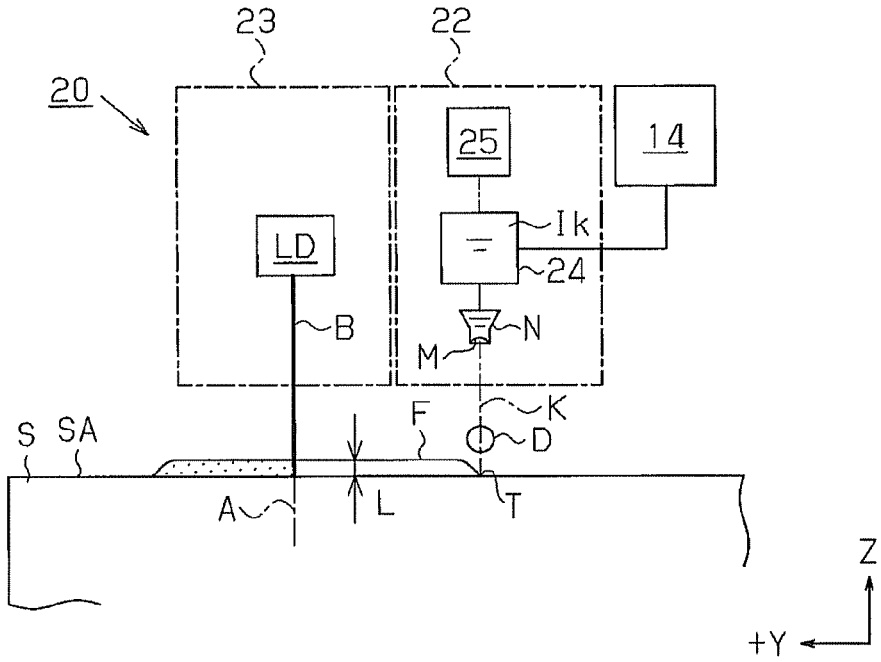
FIG. 9 schematically shows the interior of a droplet discharge device of a second embodiment.

In FIG. 9, the droplet discharge head 22 discharges a plurality of droplets D onto the discharge surface SA to form a liquid film F continuing along the +Y direction.

In the present embodiment, the film thickness of the liquid film F is referred to as the "liquid thickness L".

This liquid thickness L is determined depending on the size of the droplet D.

Namely, the liquid thickness L is determined by the drive waveform signals COM input to the pressure generation element 25.

In the embodiment, the liquid thickness L is selected to be suitable for the uniform dry of the droplet D.

The laser head 23 forms the optical axis A extending in the vertical direction from the laser LD for the liquid film F to be irradiated with the laser light B.

The laser light B absorbed into the liquid film F vaporizes a solvent or a dispersion medium of the ink Ik, causing the ink Ik to start drying.

The laser light B passing through the liquid film F arrives at the discharge surface SA and is reflected at a reflectance R.

The liquid film F is irradiated with the reflected laser light B again to be absorbed into the liquid film F, so that the ink Ik further dries.

In the embodiment, light that is incident on the liquid film F is referred to as "incident light Bi" and light that reflects from the discharge surface SA is referred to as "reflected light Br".

The liquid film F receiving the laser light B has an increased viscosity due to drying by the incident light Bi and the reflected light Br.

With an increase in viscosity, the liquid film F is fixed with an increase in suppression of its wetting and spreading.

This allows the droplet discharge device 10 to process a pattern of a functional film (e.g., metal film) made of a functional material with high precision.

Next, a relationship between the absorption coefficient $\alpha$ for the laser light B that the ink Ik has and the liquid thickness L will be described below.

Figure 10:
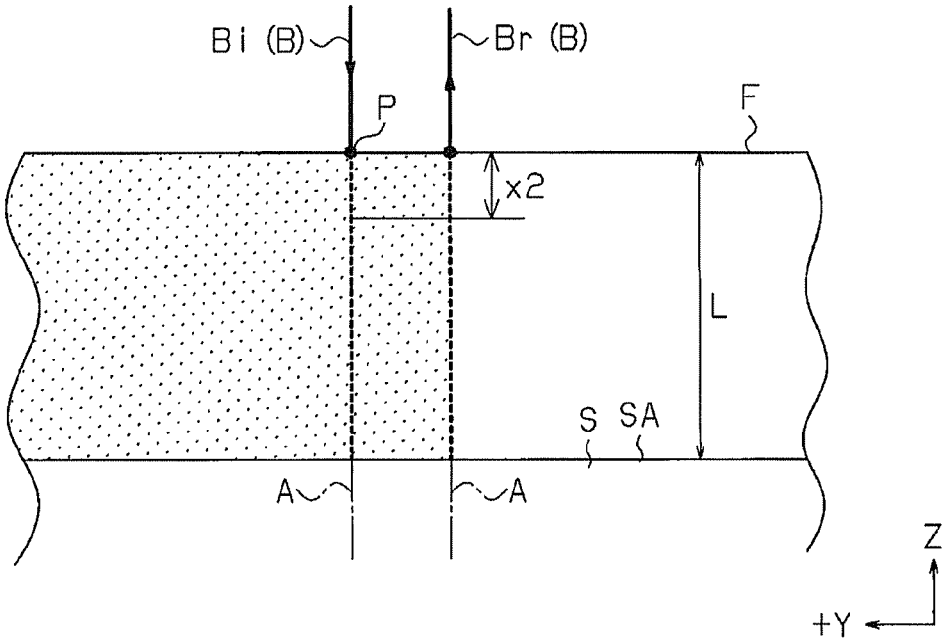
FIG. 10 schematically shows a state of irradiation of laser light of the same embodiment as in FIG. 9.

FIG. 10 schematically shows a state of the incident light Bi that is incident on the liquid film F and the reflected light Br that reflects from the discharge surface SA.

In FIG. 10, an intersection of the incident light Bi and the surface of the liquid film F is referred to as the "origin P".

In FIG. 10, a one-dimensional coordinate system is defined on the optical axis A including the origin P, and a coordinate x2 is defined from the origin P toward the discharge surface SA.

In FIG. 10, the absorption amount E of the laser light B absorbed by the ink Ik on the coordinate x2 is a value obtained by adding the absorption amount E of the incident light Bi to the absorption amount E of the reflected light Br.

In the embodiment, the absorption amount E of the incident light Bi is referred to as an "incident absorption amount Ei", and the absorption amount E of the reflected light Br as a "reflection absorption amount Et".

Setting x2=x1 allows the incident absorption amount Ei on the coordinate x2 to be expressed by the equation (1-3) as in the first embodiment.

The reflection absorption amount Et on the coordinate x2 can be expressed by setting x2=2L−x1 and multiplying the absorption amount E obtained from the equation (1-3) by the reflectance R.

Figure 11:
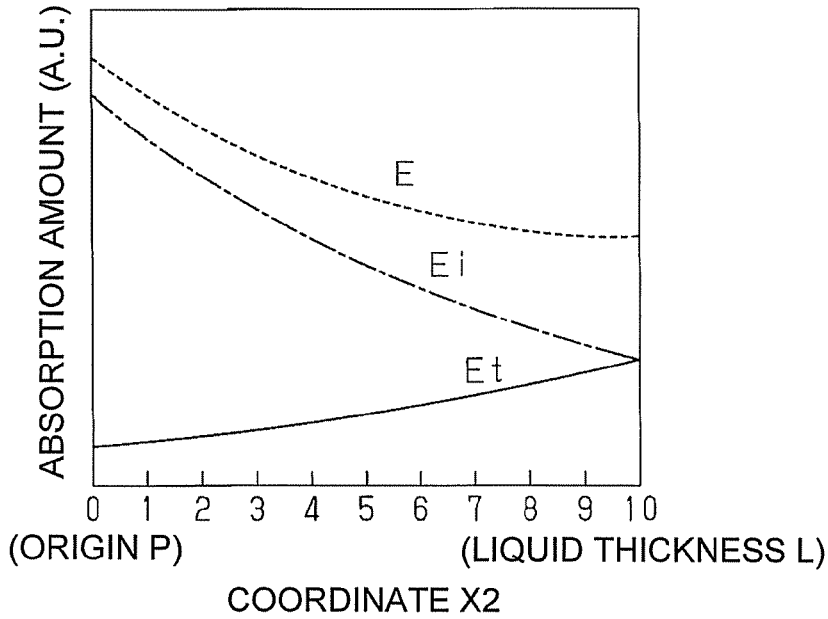
FIG. 11 shows relationships between the absorption amount and the liquid thickness of the same embodiment as in FIG. 9.

Relationships between the coordinate x2 and these incident absorption amount Ei, the reflection absorption amount Et and the absorption amount E are shown in FIG. 11.

Note that the reflectance R is set to 100% in FIG. 11.

In FIG. 11, regarding the liquid film F as indicated by an alternate long and short line, the incident absorption amount Ei is the largest at the origin P, decreases with an increase in distance from the origin P, and is the smallest at the discharge surface SA.

Also regarding the liquid film F as indicated by a continuous line, the reflection absorption amount Et continues from the incident absorption amount Ei at the discharge surface SA, decreases with an increase in distance from the discharge surface SA, and is the smallest at the origin P.

Also regarding the liquid film F as indicated by a broken line, the absorption amount E is the largest at the origin P, decreases with an increase in distance from the origin P, and is the smallest at the discharge surface SA.

Accordingly, it is found that the uniform dry state of the liquid film F is obtained by making the absorption amount E of the discharge surface SA (x2=L) closer to the absorption amount E of the origin P (x2=0).

Supposing that the ratio of the absorption amount E of the discharge surface SA (x2=L) to the absorption amount E of the origin P (x2=0) is referred to as an "absorption ratio ED", the absorption ratio ED is expressed by an equation (2-1) by the use of the equation (1-3).

In the present invention, in order that the liquid film F uniformly dry, the difference in the absorption amount E between the origin P and x2=L must be 80% or less of the absorption amount E of the origin P, i.e., $(1-ED) \leqq 0.8$.

When the absorption ratio ED satisfies $ED \geqq ra$ $(1>ra>0)$, the range of $a \cdot L$ is expressed by an equation (2-2) by the use of the equation (2-1).

Consequently, in order that the liquid film F uniformly dry, $\alpha \cdot L$ is set to a value satisfying ra=1-0.8 in the equation (2-2), i.e., a value satisfying the equation (2).

$$ED = \frac{10^{-\alpha \cdot L}(1+R)}{1+R \cdot 10^{-2\alpha \cdot L}} \quad (2\text{-}1)$$

$$\alpha \cdot L \leq \log \frac{1+R+\sqrt{1+2(1-2ra^2)R+R^2}}{2ra} \quad (2\text{-}2)$$

$$\alpha \cdot L \leq 0.43 \cdot \log(2.5+2.5R+2.5\sqrt{1+1.8R+R^2}) \quad (2)$$

Supposing that the rate of total energy of the laser light B absorbed by the ink Ik between the origin P and the coordinate x2 with respect to the energy of the laser light B at the origin P is an absorptance ER, the absorptance ER is expressed by an equation (2-3) by the use of the equation (1-3).

In the invention, in order to secure the efficiency in the use of the laser light B, the absorptance ER of the liquid film F must be 0.2 or more, which is the same as in the first embodiment.

When the absorptance ER satisfies ER≧Ea (1>Ea>0), the range of $\alpha \cdot L$ is expressed by an equation (2-4) by the use of the equation (2-3).

Thus, in order that the liquid film F uniformly dry, $\alpha \cdot L$ is set to a value satisfying Ea=0.2 in the equation (2-4), i.e., a value satisfying the equation (3).

$$ER = 10^{-2\alpha \cdot L}(-1+10^{\alpha \cdot L})(10^{\alpha \cdot L}+R) \quad (2\text{-}3)$$

$$\alpha \cdot L \geq \log \frac{10^{\frac{\alpha \cdot L}{2}}\sqrt{-1+10^{\alpha \cdot L}}}{\sqrt{1-10^{\alpha \cdot L}+10^{\alpha \cdot L}Ea\sqrt{R}}} \quad (2\text{-}4)$$

$$\alpha \cdot L \geq 0.43 \cdot \log[0.13(5.0-5.0R+5.0\sqrt{1+1.2R+R^2})] \quad (3)$$

Therefore, in the droplet discharge device 10, $\alpha \cdot L$ satisfying the above equations (2) and (3) is set by the selection of the diameter of the droplet D.

This allows each liquid film F to absorb the laser light B in a uniform manner and with high use efficiency.

As a result, the droplet discharge device 10 can make the dried condition of the droplet D uniform to cause the surface and the interior of the liquid film F to dry in a uniform manner, thereby leading to improvement in processing precision of a pattern formed of the droplets D.

The droplet discharge device 10 can also suppress the output of the laser light B to be low, thereby allowing saving of energy.

Next, effects of the second embodiment configured as described above will be described below.

(3) In the above second embodiment, supposing that the thickness of the ink Ik on the optical axis A of the laser light B is a liquid thickness L, the absorption coefficient of the ink Ik for the laser light B is a, and the reflectance of the laser light B on the discharge surface SA is R, the droplet discharge device 10 selects and sets the liquid thickness L such that it satisfies the equations (2) and (3).

Accordingly, the laser light B from the laser LD and the laser light B reflected by the discharge surface SA in corporation with each other are absorbed uniformly over the ink Ik.

Thus, the droplet discharge device 10 can make the dry state of the ink Ik uniform, and therefore can improve the processing precision of a pattern made of the ink Ik.

(4) In the above second embodiment, the droplet discharge device 10 discharges a plurality of droplets D onto the substrate S and unites the droplets D landing on the substrate S, thereby forming the liquid film F.

When irradiating the liquid film F with the laser light B, the droplet discharge device 10 sets $\alpha \cdot L$ to a value satisfying the equations (2) and (3).

Accordingly, the laser light B with which the liquid film F is irradiated is uniformly absorbed into the whole of the liquid film F along the proceeding direction of the laser light B.

Third Embodiment

A third embodiment that gives a concrete form to the present invention will be described below referring to FIG. 12.

The third embodiment changes the laser LD of the first and second embodiments to that of a wavelength modulation type.

Therefore, the changes will be described in detail below.

Figure 12:
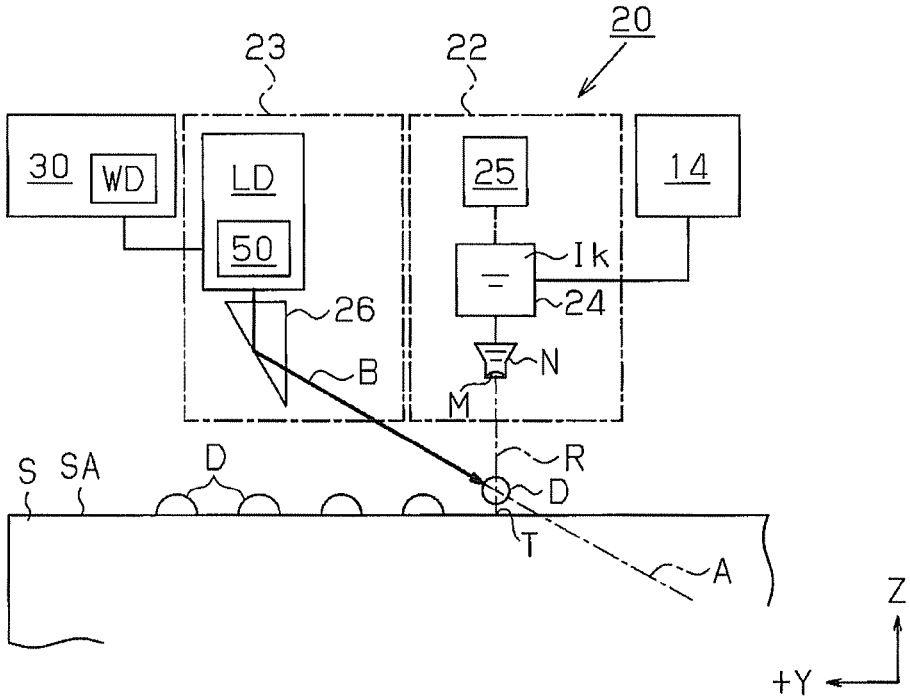
FIG. 12 schematically shows the interior of a droplet discharge device of a third embodiment.

In FIG. 12, the laser LD has a wavelength modulator 50 that modulates the wavelength of the laser light B to be emitted.

The wavelength modulator 50 is connected to the control device 30 to modulate the wavelength of the laser light B emitted from the laser LD depending on control signals from the control device 30.

As the wavelength modulator 50, optical modulators, such as optical elements made of a combination of diffraction gratings and reflecting mirrors and non-linear optical elements, can be used that enable external modulation.

The wavelength modulator 50 may be of a reactance modulation system that modulates the wavelength of the laser light B from the laser LD by modulating a drive current input to the laser LD.

The control device 30 stores wavelength data WD (e.g., a look-up table) for associating the wavelength of the laser light B with the absorption coefficient $\alpha$.

When irradiating the droplet D on the flight path K with the laser light B, the control device 30 refers to the wavelength data WD and selects the wavelength for obtaining the absorption coefficient $\alpha$ satisfying the equation (1) on the basis of the liquid thickness L set in advance.

The control device 30 generates control signals for emitting the laser light B with the selected wavelength and outputs the signals to the laser head 23.

When irradiating the ink Ik with the laser light B utilizing the reflection of the discharge surface SA, the control device 30 refers to the wavelength data WD and selects the wavelength for obtaining the absorption coefficient $\alpha$ that satisfies the equations (2) and (3) on the basis of the liquid thickness L set in advance.

The control device 30 generates control signals for emitting the laser light B with the selected wavelength and outputs the signals to the laser head 23.

Next, effects of the third embodiment configured as described above will be described below.

(5) In the above third embodiment, the droplet discharge device 10 sets the absorption $\alpha$ that satisfies the equation (1), or the equation (2) and the equation (3), by the selection of the wavelength of the laser light B.

Accordingly, the droplet discharge device 10 performs discharge processing under a condition that satisfies the equation (1), or the equation (2) and the equation (3), and therefore can cause the discharged ink Ik to absorb the laser light B in a uniform manner and with high use efficiency.

In addition, the droplet discharge device 10 can expand the range of conditions of discharge processing as the wavelength of the laser light B is selectable.

Fourth Embodiment

A fourth embodiment that gives a concrete form to the invention will be described below referring to FIG. 13.

The fourth embodiment changes the ink Ik of the first embodiment to coloring matter-containing ink Ia.

Therefore, the changes will be described in detail below.

Figure 13:
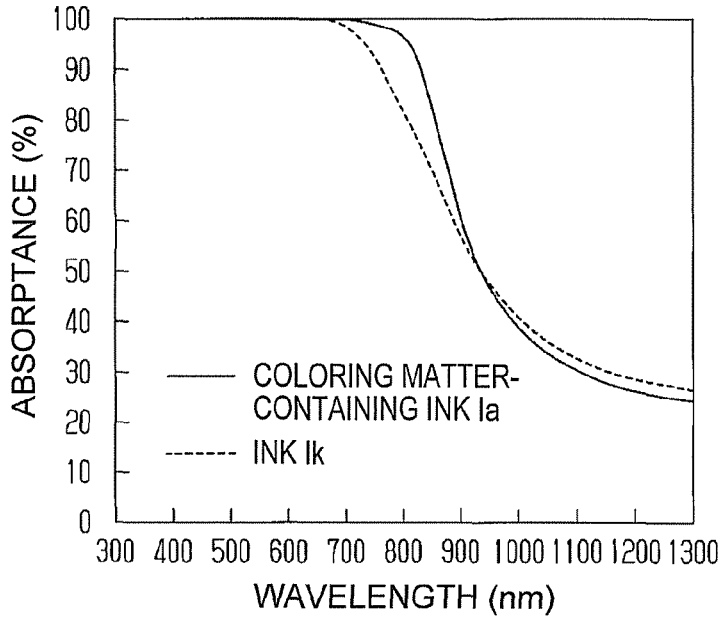
FIG. 13 shows the dependence of the absorptance of ink on the wavelength of a fourth embodiment.

In FIG. 13, the ink Ik is silver ink in which silver fine particles as a functional material are dispersed in a water-type solvent.

The coloring matter-containing ink Ia is ink in which an infrared-ray absorbing coloring matter having a predetermined concentration is added to the ink Ik.

As indicated by a broken line, the ink Ik has an absorptance of 95% or more at wavelengths from 300 (nm) to about 700 (nm), and the absorptance gradually decreases at wavelengths above about 700 (nm).

On the other hand, coloring matter-containing ink Ia has, at wavelengths from about 700 (nm) to about 950 (nm), an absorptance higher than that of the ink Ik.

Accordingly, the droplet discharge device 10 can change the absorption coefficient $\alpha$ at wavelengths from about 700 (nm) to about 950 (nm) by changing the ink Ik to the coloring matter-containing ink Ia.

In addition, the droplet discharge device 10 can modulate the absorption coefficient $\alpha$ at wavelengths from about 700 (nm) to about 950 (nm) by selecting the concentration of a coloring matter contained in the coloring matter-containing ink Ia.

The ink tank 14 of the droplet discharge device 10 contains plural pieces of the coloring matter-containing ink Ia having different concentrations, and independently supplies each piece of the coloring matter-containing ink Ia to the droplet discharge head 22.

The control device 30 of the droplet discharge device 10 stores concentration data (e.g., a look-up table corresponding to an absorptance curve in FIG. 13) for associating the coloring matter concentration with the absorption coefficient $\alpha$.

When irradiating the droplet D on the flight path K with the laser light B, the control device 30 refers to the concentration data, and selects the wavelength for obtaining the absorption coefficient $\alpha$ that satisfies the equation (1) on the basis of the liquid thickness L set in advance.

The control device 30 generates control signals for supplying the coloring matter-containing ink Ia with the selected concentration to each nozzle N and outputs the signals to the droplet discharge head 22.

When irradiating the ink Ik with the laser light B utilizing the reflection of the discharge surface SA, the control device 30 refers to the concentration data, and selects the concentration for obtaining the absorption coefficient $\alpha$ that satisfies the equations (2) and (3) on the basis of the liquid thickness L set in advance.

The control device 30 generates control signals for supplying the coloring matter-containing ink Ia with the selected concentration to each nozzle N and outputs the signals to the droplet discharge head 22.

Next, effects of the fourth embodiment configured as described above will be described below.

(6) In the above fourth embodiment, the droplet discharge device 10 sets the absorption coefficient $\alpha$ that satisfies the equation (1), or the equation (2) and the equation (3), by the selection of the wavelength of the laser light B.

Accordingly, the droplet discharge device 10 performs discharge processing under a condition that satisfies the equation (1), or the equation (2) and the equation (3), and therefore can cause the discharged ink Ik to absorb the laser light B in a uniform manner and with high use efficiency.

In addition, the droplet discharge device 10 can expand the range of conditions of discharge processing as the concentration of the coloring matter-containing ink Ia is allowed to be selected.

Fifth Embodiment

A fifth embodiment that gives a concrete form to the invention will be described below referring to FIG. 14.

The fifth embodiment changes the deflector 26 of the second embodiment.

Therefore, the changes will be described in detail below.

Figure 14:
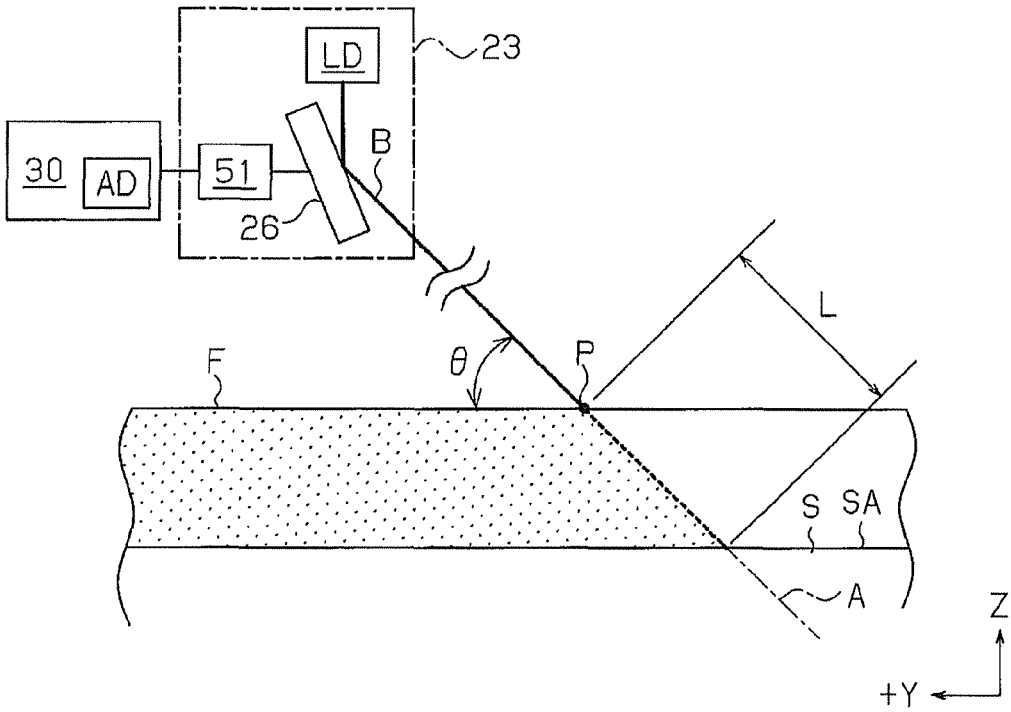
FIG. 14 schematically shows a droplet discharge device of a fifth embodiment.

In FIG. 14, the laser head 23 has a deflector driver 51 that drives the deflector 26 to change the deflection direction of the laser light B.

The deflector driver 51 is connected to the control device 30, and drives the deflector 26 in response to control signals from the control device 30 to cause the deflection direction of the laser light B emitted from the laser LD to be selected to a predetermined direction.

In the embodiment, the angle between the discharge surface SA and the optical axis A is referred to as an "incident angle $\theta$".

When irradiating the ink Ik with the laser light B utilizing the reflection of the discharge surface SA, the control device 30 refers to incident angle data AD, and selects the incident angle $\theta$ for obtaining the absorption coefficient $\alpha$ that satisfies the equations (2) and (3) on the basis of the liquid thickness L set in advance.

The control device 30 generates control signals for emitting the laser light B with the selected incident angle $\theta$ and outputs the signals to the laser head 23.

Next, effects of the fifth embodiment configured as described above will be described below.

(7) In the above fifth embodiment, the droplet discharge device 10 sets the liquid thickness L that satisfies the equation (2) and the equation (3) by the selection of the incident angle $\theta$ of the laser light B.

Accordingly, the droplet discharge device 10 performs discharge processing under a condition that satisfies the equation (2) and the equation (3), and therefore can cause the discharged ink Ik to absorb the laser light B in a uniform manner and with high use efficiency.

In addition, the droplet discharge device 10 can set the liquid thickness L without changing the film thickness of the liquid film F, allowing the range of conditions of discharge processing to be expanded.

Note that the above embodiment may be modified as follows.

In the above second embodiment, the droplet discharge device 10 sets the liquid thickness L of the liquid film F by the selection of the size of the droplet D.

Figure 15:
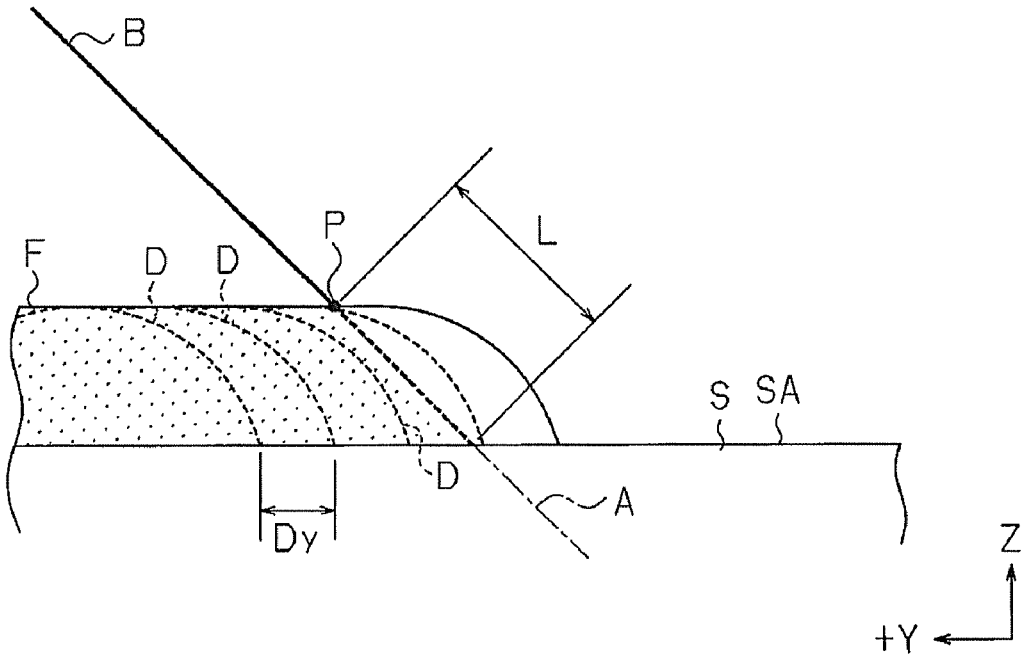
FIG. 15 schematically shows a droplet discharge method of a modification.

Setting of the liquid thickness L is not limited to such. For example, as shown in FIG. 15, the liquid thickness L that satisfies the equation (1), or the equation (2) and the equation (3) may be set by the selection of an interval at which the droplet D is discharged, i.e., a discharge pitch Dy.

In the second embodiment, the laser head 23 applies the laser light B to the liquid film F.

The application of the laser light B is not limited to such, and the laser head 23 may apply the laser light B toward the droplet D standing alone on the discharge surface SA.

In the above second embodiment, the laser head 23 applies the laser light B along the normal line of the discharge surface SA.

The application of the laser light B is not limited to such, and the laser head 23 may apply the laser light B along a direction inclined with respect to the normal line of the discharge surface SA.

In the above fourth embodiment, regarding the ink Ik, the absorption coefficient α is set to a desired value by the selection of an adding amount of the coloring matter.

Setting of the absorption coefficient α is not limited to such, and, regarding the ink Ik, the absorption coefficient α may be set to a desired value by the selection of the concentration of a functional material.

Alternatively, regarding the ink Ik, the absorption coefficient α may be set to a desired value by the selection of the particle size and the distance between particles of a functional material (e.g., dispersion medium).

Even in this configuration, the droplet discharge device 10 performs discharge processing under a condition that satisfies the equation (1), or the equation (2) and the equation (3), and therefore can cause the discharged ink Ik to absorb the laser light B in a uniform manner and with high use efficiency.

In the above embodiments, light is laser light from the laser LD.

The light is not limited to such, and the light may be light from an LED (light-emitting diode).

In the above embodiments, either of the number of nozzle rows and the number of laser rows is one.

The number of nozzle rows or laser rows is not limited to such, and may be two or more.

In the above embodiments, the head unit 20 moves in the −Y direction relatively with respect to the substrate S by the movement of the stage 12 in the +Y direction.

The movement is not limited to such, and the carriage 15 is configured to be movable in the −Y direction.

The head unit 20 may move in the −Y direction relatively with respect to the substrate S by the movement of the carriage 15 in the −Y direction.

The entire disclosure of Japanese Patent Application No.2007-201980, filed Aug. 2, 2007 is expressly incorporated by reference herein.

What is claimed is:

1. A pattern formation method, comprising:

discharging droplets of a functional liquid substance including a functional material to an object;

irradiating the droplets of a functional liquid substance with light emitted from a light source at a point before the droplets contact the object to partially dry the droplets; and contacting the partially-dried droplets on the object to thereby form a pattern of a functional film on the object, wherein when a diameter of each droplet of the functional liquid substance along an optical axis of the light is L and an absorption coefficient of the functional liquid substance for the light is α, the diameter and the absorption coefficient are set so as to satisfy an equation (1):

$$0.1 \leqq \alpha \cdot L \leqq 0.7 \quad (1).$$

2. The pattern formation method according to claim 1, wherein the light is laser light, and the absorption coefficient is set by selection of a wavelength of the laser light.

3. The pattern formation method according to claim 1, wherein the absorption coefficient is set by selection of a concentration of the functional material.

4. The pattern formation method according to claim 1, wherein the functional liquid substance is a liquid including a coloring matter that absorbs the light, and the absorption coefficient is set by selection of a concentration of the coloring matter.

5. The pattern formation method according to claim 1, wherein the functional material is a metal particle, and the absorption coefficient is set by selection of at least one of a particle size of the metal particle and a distance between particles of the metal particle.

6. A pattern formation method, comprising:

discharging droplets of a functional liquid substance including a functional material to an object to form a liquid film;

irradiating the liquid film of the functional liquid substance with light emitted from a light source, and light emitted from the light source and reflected by the object thereby to begin drying of the liquid film and form a pattern of a functional film on the object, wherein when a thickness of the liquid film along an optical axis of the light is L, an absorption coefficient of the functional liquid substance for the light is α, and a reflectance of the light by the object is R, the thickness and the absorption coefficient are set so as to satisfy equations (2) and (3):

$$\alpha \cdot L \leq 0.43 \cdot \log(2.5 + 2.5R + 2.5\sqrt{1 + 1.8R + R^2}) \quad (2)$$

$$\alpha \cdot L \geq 0.43 \cdot \log[0.13(5.0 - 5.0R + 5.0\sqrt{1 + 1.2R + R^2})] \quad (3).$$

7. The pattern formation method according to claim 6, wherein the light is laser light, and the absorption coefficient is set by selection of a wavelength of the laser light.

8. The pattern formation method according to claim 6, wherein the absorption coefficient is set by selection of a concentration of the functional material.

9. The pattern formation method according to claim 6, wherein the functional liquid substance is a liquid including a coloring matter that absorbs the light, and the absorption coefficient is set by selection of a concentration of the coloring matter.

10. The pattern formation method according to claim 6, wherein the functional material is a metal particle, and the absorption coefficient is set by selection of at least one of a particle size of the metal particle and a distance between particles of the metal particle.

* * * * *